United States Patent [19]

Sakurai

[11] 4,443,794

[45] Apr. 17, 1984

[54] CHARACTER PROCESSING DEVICE

[75] Inventor: Atsushi Sakurai, Yokohama, Japan

[73] Assignee: Canon Kabushiki Kaisha, Tokyo, Japan

[21] Appl. No.: 372,555

[22] Filed: Apr. 28, 1982

Related U.S. Application Data

[63] Continuation of Ser. No. 152,732, May 23, 1980.

[30] Foreign Application Priority Data

Jun. 1, 1979 [JP] Japan ..... 54-68559

[51] Int. Cl.[3] ..... G09G 1/00

[52] U.S. Cl. ..... 340/748; 340/735; 340/723; 340/347 DD

[58] Field of Search ..... 340/735, 790, 450, 748, 340/744, 720, 723, 347 DD

[56] References Cited

U.S. PATENT DOCUMENTS

| | | | |
|---|---|---|---|
| 3,821,730 | 6/1974 | Carey et al. | 340/750 |
| 3,980,874 | 9/1976 | Vora | 340/347 DD |
| 4,122,533 | 10/1978 | Kubinak | 340/790 |
| 4,181,973 | 1/1980 | Tseng | 340/790 |
| 4,319,225 | 3/1982 | Klose | 340/347 DD |
| 4,364,025 | 12/1982 | Dalton | 340/347 DD |

*Primary Examiner*—Marshall M. Curtis

*Attorney, Agent, or Firm*—Fitzpatrick, Cella, Harper & Scinto

[57] ABSTRACT

A character processing device is disclosed that is capable of representing function codes, which comprise at least a portion of information processing codes input to the device, as a single character code pattern comprising a first character code pattern representative of a classifying character code, which indicates that a function code has been input to the device, and second character code pattern representative of a function character code, which indicates the function represented by the function code.

5 Claims, 6 Drawing Figures

| LOWER \ UPPER | 0 | 1 | 2 | 3 | 4 | 5 | 6 | 7 |
|---|---|---|---|---|---|---|---|---|
| 0 | NuL | DLE | ~~b~~ | 0 | @ | P | | |
| 1 | SōH | DC1 | ! | 1 | A | Q | | |
| 2 | STX | DC2 | " | 2 | B | R | | |
| 3 | | | | | C | S | | |
| 4 | | | | | D | T | | |
| 5 | | | | | E | U | | |
| 6 | | | | | F | V | | |
| 7 | | | | | G | W | | |
| 8 | | | | | H | X | | |
| 9 | | | | | I | Y | | |
| A | | | | | J | Z | | |
| B | | | + | | K | [ | | |
| C | | | | | L | ¥ | | |
| D | CR | | | | M | ] | | |
| E | | | | | N | ^ | | |
| F | | | | | O | — | | |
| | 1 | | 2 | | | | | |

CHARACTER PROCESSING DEVICE

This is a continuation of application Ser. No. 152,732, filed May 23, 1980.

BACKGROUND OF THE INVENTION

1. Field of the Invention

The present invention relates to a character processing device that represents function codes, comprising at least a portion of the information processing codes input to the device, as a single character or character code pattern.

2. Description of the Prior Art

Information processing codes used to control various electronic devices typically include function codes that are utilized solely for controlling the function of the information transmitting apparatus of such devices. For example, in FIG. 1, 32 function codes are illustrated at (1) while various character codes are illustrated at 2.

As will be understood from FIG. 1, these codes are represented by two digits of sextodecimal numbers.

The function codes 1 do not have commonly accepted character representations as do the character codes. For this reason various methods of representing these function codes have been proposed, but a unified system for such representation including the character codes has not been developed because each function code requires multiple characters for representation. For example a function code representing "carriage return" requires 8 characters "00001101" in binary representation, 2 characters "OD" in sextodecimal representation, and 2 characters "CR" in character representation.

SUMMARY OF THE INVENTION

Considering the foregoing, an object of the present invention is to provide a character processing device capable of representing all information processing codes, including both function and character codes, with single characters or character code patterns.

Another object of the present invention is to provide a character processing device which represents each function code as a single character comprising two superposed character codes or character code patterns one of which indicates that the character stands for a function code while the other of which indicates the represented function.

Still another object of the present invention is to provide a character processing device capable of displaying the character codes and function codes within the same visual length.

Still other objects of the present invention will be made apparent from the following description of the preferred embodiments to be taken in conjunction with the accompanying drawings.

DESCRIPTION OF THE PREFERRED EMBODIMENTS

The present invention will be described in detail with reference to a display device that embodies it.

Figures 1, 2:
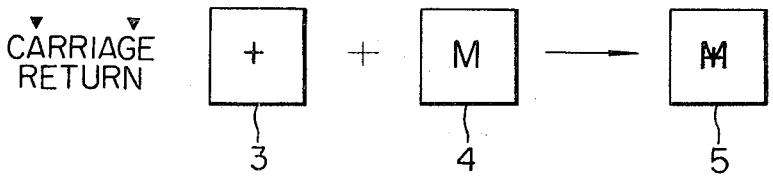
FIG. 1 is a table of typical information processing codes.
FIG. 2 is an explanatory view showing the method of synthesizing function codes.

FIG. 2 shows as an example the function code "carriage return" or "CR" represented by a synthesized code comprising superposed character code patterns, "M" and "+".

In this example the character code pattern "M" represents a function character code indicating the function "carriage return" and the character code pattern "+" superposed thereover represents a classifying character code indicating that a function code has been input to the device.

In this embodiment the symbol "+" represents the classifying character code while 32 characters in the fourth and fifth columns shown in FIG. 1 may each represent a different function as well as their known character. It is however naturally possible to employ other combinations of characters for representing the function codes.

Figure 3:
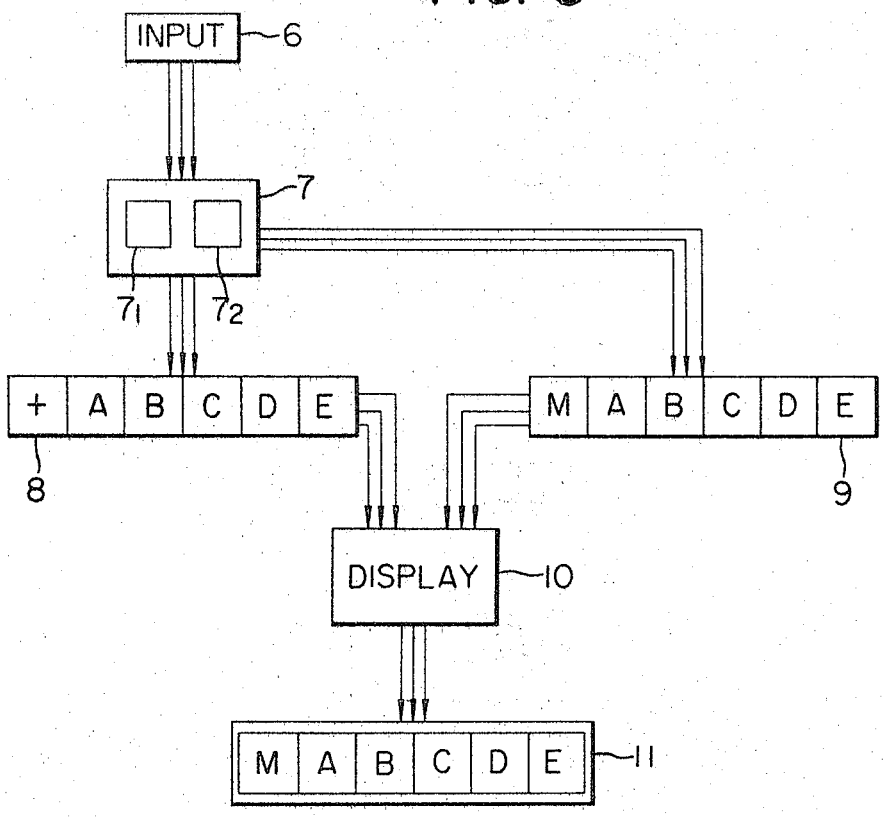
FIG. 3 is a block diagram of the character processing device embodying the present invention.

FIG. 3 shows an embodiment of the character processing device capable of providing such synthesized character code patterns. In the following description it is assumed that the information processing codes including function codes and character codes, are each processed as a sextodecimal number in the form (##) 16, where # indicates a digit of sextodecimal number.

In FIG. 3 an input terminal 6 is used to input character codes and function codes in the form of sextodecimal numbers as shown in FIG. 1. An arithmetic unit 7 comprises a memory $7_1$ for storing the information processing code instruction sequence and data for processing the input information processing codes to be explained later, and a processor $7_2$ capable of addition and comparison.

A first memory unit 8 and a second memory unit 9 are adapted to store the information processing codes supplied from the arithmetic unit 7. A display circuit 10 is adapted to selectively transmit the information processing codes supplied from the first and second memory units 8, 9. A display unit 11 is adapted to provide a visual display of characters on display elements corresponding to the information codes supplied from the display circuit 10. In another embodiment the display unit may be a printer.

The function of the embodiment described above will now be explained as follows.

Referring to FIG. 3, each information processing code input from the input terminal 6 is first identified by the arithmetic unit 7 as either a function code or merely a character code. As shown in FIG. 1, each of the function and character codes is represented by 2-digit sextodecimal numbers. Consequently the identification is achieved by comparing the input information processing code with the sextodecimal number (20) 16. Since all function codes are smaller than (20) 16 (cf. FIG. 1) if the sextodecimal number input to the arithmetic unit 7 is less than (20) 16, the input information processing code represented thereby is a function code; if greater than or equal to (20) 16, the information processing code represented thereby is a character code.

If the input code is identified as a character code, it is stored both in the first and second memory units 8, 9.

On the other hand, if the input code is identified as a function code, it is then added to (40) 16 to obtain the character in the fourth and fifth columns used as the identifying characters that represents the function represented by the input function codes, and the result of the addition is stored in the second memory unit 9.

Thereafter the classifying character code for the character code pattern "+"((2B) 16 in sextodecimal representation) is retrieved from the memory $7_1$ in the arithmetic unit and is stored in the first memory unit 8.

Figure 4:
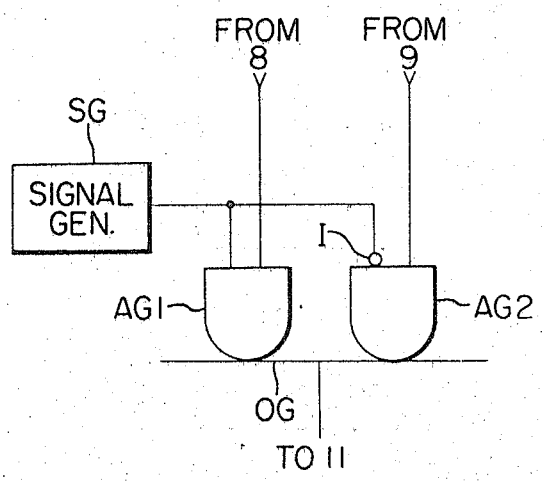
FIG. 4 is a block diagram of the display circuit.

As shown in FIG. 4, the display circuit comprises a signal generator SG for alternately signaling the the first memory unit 8 and the second memory unit 9 to transmit their contents to the display unit 11, and a gate circuit including of AND gates AG1, AG2, OR gates OG and an inverter I for selecting the memory unit, the contents of which are transmitted at any one time in response to the output signal from said signal generator SG.

Figure 5:
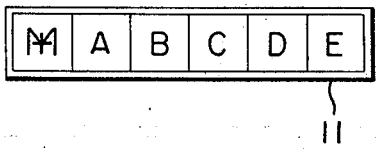
FIG. 5 is a view of function codes obtained on the display device.

Thus the display circuit transmits, alternately and cyclically at regular intervals, the contents of the first and second memory units 8, 9 to the display unit 11 in response to the output signal from the signal generator SG, which contents are used to produce a display as shown in FIG. 5. Thus, by selecting a suitable interval, the function codes are represented by superposed character code patterns, that is a single character code pattern, in the example given above "M" and "+" as "M", while the character codes are shown by the character code patterns representative thereof on the display unit 11.

Figure 6:
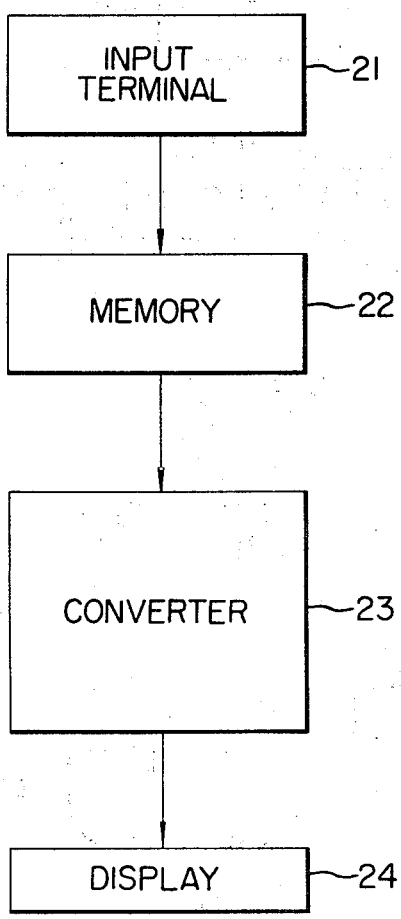
FIG. 6 is a block diagram showing another embodiment.

FIG. 6 shows another embodiment of the present invention as a block diagram, in which an input terminal 21 transmits the function codes and character codes as shown in FIG. 1 in sextodecimal 2-digit numbers. A memory unit 22 is adapted to store the function and character codes transmitted from the input terminal 21. A converter 23 stores the character code patterns of the function and character codes corresponding to the sextodecimal 2-digit numbers of the function and character codes. Such character code patterns for the function codes may be synthesized characters as explained in the foregoing or may be completely different patterns as long as they can be represented by limited number of characters. A character code unit 24 provides visual display of the display patterns supplied from said converter 23. The display unit may, of course, further be a printer.

In the above-explained embodiment the codes supplied from the input terminal 21 are supplied through the memory unit 22 to the converter 23, and displayed on the display unit 24.

As explained above, the present invention enables representation of each function code, comprising at least a part of the information processing codes, as a single character code pattern comprising a first character code pattern representative of a classifying character code and a second character code pattern representative of the function character code that indicates the function to be performed thereby achieving a one-code-one-character code pattern representation which has not been realized in the past. Therefore information handling is smooth.

It is also possible to change the first character code pattern representing the classifying character code to another non-graphic symbol, and to employ the identifying characters appearing on the keys of the input device thereby reducing the errors in the key input entry operations.

What I claim is:

1. A character processing device comprising:

input means for inputting to said device a plurality of established numeric codes, a first predetermined range of numerical values of said numeric codes representing function codes and a second predetermined range of numerical values of said numeric codes representing character codes;

identifying means for receiving numeric codes input to said device by said input means and identifying each numeric code as a function code or a character code by comparing the numerical value of each received numeric code with the first and second predetermined ranges;

converting means operable when said identifying means identifies a numeric code representing a function code to convert the function code into a classifying character code and a function character code, the classifying character code constituting a signal that a function code has been identified, and the function character code constituting a signal of the function represented by the function code;

memory means including a first memory unit for storing said classifying character code and a second memory unit for storing said function character code;

selecting means for selecting a first character code pattern representative of the classifying character code stored in said first memory unit and a second character code pattern representative of the function character code stored in said second memory unit; and synthesizing means for producing a single code pattern from the first and the second character code patterns respectively selected by said selecting means.

2. A character processing device according to claim 1, wherein said selecting means comprises signal generating means for signaling said memory means to alternately and cyclically put out the classifying character code stored in said first memory unit and the function character code stored in said second memory unit.

3. A character processing device according to claim 2, further comprising means, operable when said identifying means identifies an information processing code as a character code, for transmitting the character code to both said first memory unit and said second memory unit for storage therein, and wherein said signal generating means comprises a character generating device for generating duplicate character code patterns representative of the character code stored in said first and said second memory units.

4. A character processing device according to claim 1, wherein said synthesizing means comprises means for visually displaying the first and second code patterns as synthesized as the single code pattern.

5. A character processing device comprising:

identifying means for identifying input data as function data or character data;

converting means operable when said identifying means identifies said input data as function data to convert said input data into first character data indicative of function data and second character data indicative of classification of function data, said converting means adapted to designate predetermined character data used as said first character data, to operationally process said predetermined character data on the basis of a numerical value code representative of said input data, and to designate character data representative of the numerical value code of the processed data as said second character data;

memory means including a first memory unit for storing said first character data converted by said converting means and a second memory unit for storing said second character data;

selecting means for alternately selecting said first character data and said second character data stored in said memory means; and display means for providing a superposed display of both said first character data and said second character data supplied from said selecting means.

* * * * *

UNITED STATES PATENT AND TRADEMARK OFFICE

CERTIFICATE OF CORRECTION

PATENT NO. : 4,443,794

DATED : April 17, 1984

INVENTOR(S) : ATSUSHI SAKURAI

It is certified that error appears in the above-identified patent and that said Letters Patent is hereby corrected as shown below:

Column 1

Line 20, change "(1)" to --1--.

Column 3

Line 11, between "circuit" and "comprises" insert --10--.

Line 12, delete "the", second occurrence.

Line 20, between "circuit" and "transmits" insert --10--.

Line 47, change "display", second occurrence, to --character code--.

Signed and Sealed this

Sixteenth Day of April 1985

[SEAL]

*Attest:*

DONALD J. QUIGG

*Attesting Officer*

*Acting Commissioner of Patents and Trademarks*